United States Patent [19]

Culver

[11] 3,934,535

[45] Jan. 27, 1976

[54] ROLL STABILIZER FOR A BOAT

[75] Inventor: Irven H. Culver, Playa Del Rey, Calif.

[73] Assignee: Southwestern Industries, Inc., Los Angeles, Calif.

[22] Filed: May 15, 1974

[21] Appl. No.: 469,950

Related U.S. Application Data

[63] Continuation-in-part of Ser. No. 360,668, May 15, 1973, abandoned.

[52] U.S. Cl. ..... 114/124

[51] Int. Cl.[2] ..... B63B 39/02

[58] Field of Search ..... 114/122, 124, 125; 188/1 B, 317

[56] References Cited

UNITED STATES PATENTS

| | | | |
|---|---|---|---|
| 2,629,462 | 2/1953 | Peek | 188/317 |
| 3,422,782 | 1/1969 | Ripley | 114/125 |
| 3,437,332 | 4/1969 | Lee | 188/1 B |
| 3,557,735 | 1/1971 | Dreyfus | 114/124 |

FOREIGN PATENTS OR APPLICATIONS

| | | | |
|---|---|---|---|
| 20,711 | 4/1915 | United Kingdom | 114/124 |

*Primary Examiner*—Trygve M. Blix
*Assistant Examiner*—Charles E. Frankfort
*Attorney, Agent, or Firm*—Christie, Parker & Hale

[57] ABSTRACT

A passive roll stabilizer for a boat in which a freely movable weight is supported for movement athwartships at a substantial distance above the deck on a mast or other superstructure. The weight is freely movable along an axis substantially parallel to the deck between widely spaced limits. The limits are defined by energy dissipating stops, such as spring-loaded dash pots or self-restoring plastic foam material.

9 Claims, 7 Drawing Figures

ROLL STABILIZER FOR A BOAT

RELATED INVENTION

This application is a continuation-in-part of application Ser. No. 360,668, filed May 15, 1973, and now abandoned.

FIELD OF THE INVENTION

This invention relates to passive roll stabilizers for boats, and more particularly to a stabilizer utilizing a laterally moving mass which is freely movable from side to side by the roll of the boat.

BACKGROUND OF THE INVENTION

Various types of arrangements for inhibiting or damping the rolling motion of a floating vessel have heretofore been proposed. Such arrangements can be generally categorized as active and passive systems. Active systems include such things as gyro stabilizers, servo controlled fins, and various types of ballast transferring mechanisms which forcibly reposition ballast weight to counteract the rolling motion of the vessel.

Passive systems are systems which utilize the motion of the boat itself to move a mass in such a way as to set up counteracting forces. In known systems of the passive type, a mass is caused to oscillate back and forth under the action of gravity as the ship tips one way and then the other during the rolling action. The excitation force driving the mass back and forth laterally of the ship is the lateral component of the force of gravity produced by the roll angle of the boat. Thus when the boat tips in one direction, the weight is pulled by gravity from the high side to the low side of the vessel and then when the vessel tips in the other direction the weight is pulled back by gravity. Some combination of springs for tuning the natural frequency of the oscillating system near resonance with the roll frequency of the ship together with some damping arrangement to maintain the correct phasing between the movement of the weight and the movement of the ship is required to achieve a correcting action.

Such a system is described, for example, in prior art U.S. Pat. Nos. 3,422,782 and 3,557,735. In such known systems, the weight is part of a tuned oscillating system, that is, the system is designed such that the weight is self-centering, either by springs or by inclining of the guides for the weight toward the center. Thus the weight is driven into oscillation by the rolling action of the vessel against the restoring force of the centering means. The frequency of this oscillation is tuned to the natural roll frequency of the vessel and damping is provided to control the relative phase between the motion of the weight and the motion of the vessel. While limits on the amplitude are imposed by the structure, normal operation is for the damped weight to oscillate within these limits. The limiting structure is not designed to dissipate the kinetic energy of the moving mass but merely acts to redirect the weight back toward the center of the guide structure.

Any mechanical oscillating system operating at a condition of constant amplitude requires that the energy used to drive the system must equal the energy being absorbed by damping factors in the system. This means that the maximum damping possible is proportional to the integral of the driving or excitation force maintaining the oscillation multiplied by the amplitude or distance through which the mass is moved. In conventional mechanical systems for damping rolling of a ship, the driving force is equal to the force of gravity times the sine of the roll angle, which means that the driving force available is substantially less than the force of gravity. Since the driving force is limited, the only way that substantial damping of the system can be achieved is by using a very large value of mass or by tuning the system to very near resonance to achieve a larger distance of travel for the mass, or by using a combination of more mass plus close tuning to resonance.

To increase the mass of the moving system has the obvious disadvantage that it increases the dead weight of the vessel and takes up added space. Trying to tune the system to match the roll frequency of the boat so as to drive the oscillating system near the resonance point also has a number of disadvantages. Must hulls do not have a linear relationship between the righting movement versus the roll angle, so that the rolling frequency changes with the degree of roll. An even more serious problem is that changing the load or the load distribution of the vessel can substantially change the roll frequency. This means that the natural frequency of the oscillating system must be retuned to keep the resonance frequency near the roll frequency.

SUMMARY OF THE PRESENT INVENTION

The present invention provides an improved roll stabilizer utilizing a dynamic mass which requires no energy source other than the rolling motion of the vessel being stabilized. The present system has the advantage that it does not have to be tuned to a particular roll frequency, thus the system is effective over a wide range of roll frequencies without any modification to the stabilizing apparatus to change the natural frequency of the system. Much higher acceleration forces are achieved than in systems relying primarily on the force of gravity, permitting a relatively light moving mass to stabilize the vessel. For example, a mass of less than a half percent of the weight of the vessel provides effective damping. The stabilizer does not take up useful space in the vessel and it is extremely simple in its construction and installation.

The above advantages are achieved by providing a roll stabilizer in which a mass is supported for substantially unrestricted movement between energy absorbing and dissipating limit stops. This system is mounted at substantial height above the deck of the ship to provide a large moment arm for the mass acceleration and mass damping forces.

BRIEF DESCRIPTION OF THE DRAWINGS

For a more complete understanding of the invention, reference should be made to the accompanying drawings, wherein.

DETAILED DESCRIPTION

Figure 1:
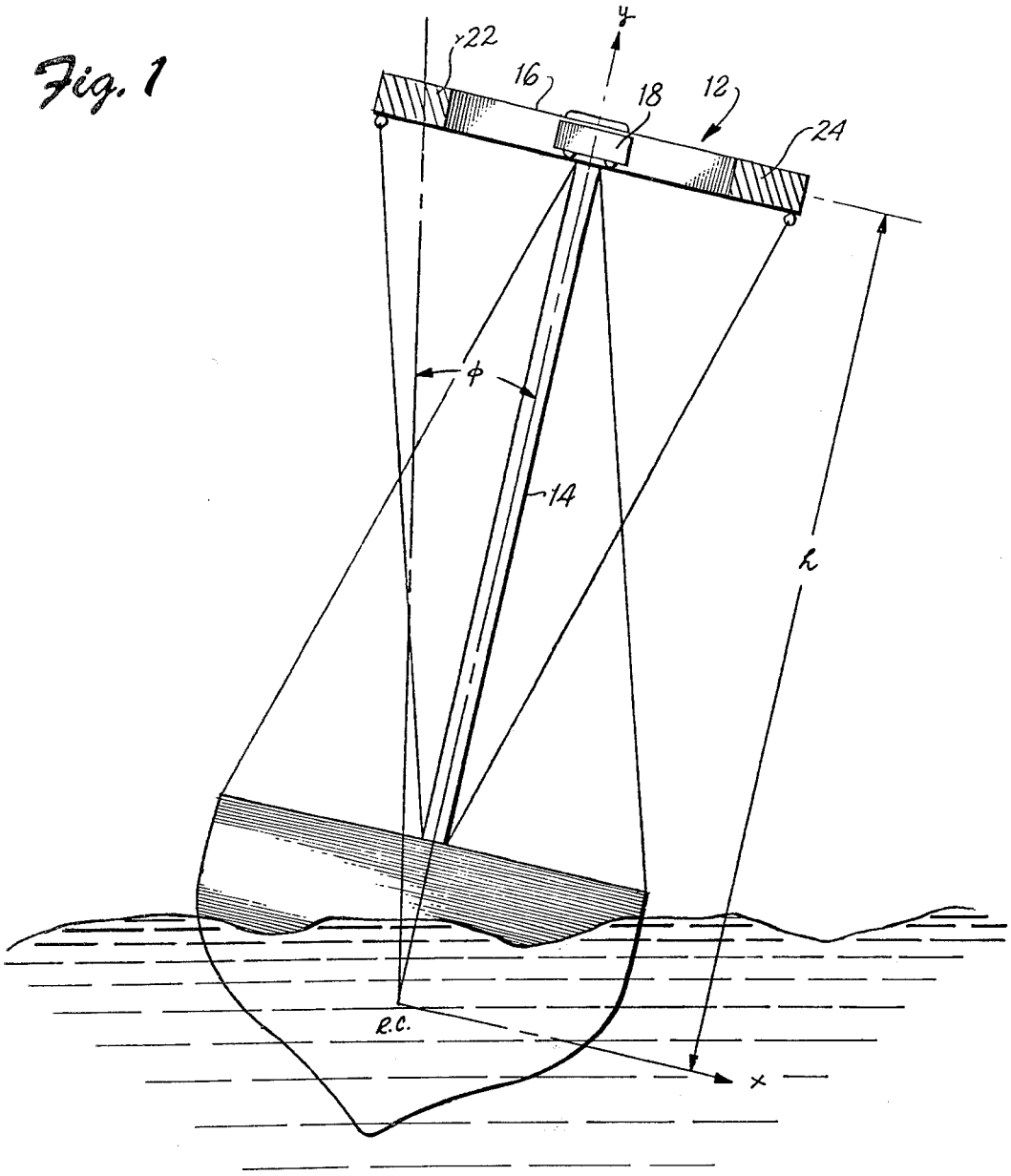
FIG. 1 is a schematic drawing of an end view of a vessel having the roll stabilizer of the present invention mounted thereon.

Referring to FIG. 1, the numeral 10 indicates the hull of a floating vessel which, when floating in water, tends to roll about a fore and aft axis called the roll center (R.C.). In the absence of any roll stabilizer, the vessel tends to roll about the roll center at a frequency which is determined by various design factors, such as the mass of the vessel and its distribution, how high the center of flotation is above the center of gravtiy, and the shape of the hull. This frequency can also vary, for example, depending upon the way the vessel is loaded. In the past, roll stabilizers utilizing a mass which oscillates transversely of the vessel in a manner to counteract the normal rolling action of the vessel have usually been positioned below the deck or on the deck so as to be close to the roll axis. The primary exciting force acting on the mass to cause it to move back and forth with the rolling of the vessel in such prior art arrangements is the force of gravity, and more particularly, the component of the force of gravity acting along the direction parallel to the path of movement of the mass. Assuming the mass acts along the path substantially parallel to the deck, the component of force acting on the mass is zero when the ship is level and increases in proportion to the sine of the roll angle as the vessel rolls to either side of the normal.

As shown in FIG. 1, the roll stabilizer assembly, indicated generally at 12, is mounted atop a mast 14 which may be part of the superstructure of the vessel. The roll stabilizing assembly 12 includes an elongated tube 16 or other suitable guidance structure supported on top of the mast 14 and extending laterally of the vessel and substantially parallel to the deck. Movably supported within the tube 16 is a weight 18 which may be provided with guide wheels 20 that provide very low friction support for the weight 18 within the tube 16. Thus the weight 18 is free to move laterally of the vessel within limits provided by a pair of limit stops 22 and 24 at either end of the tube 16. As hereinafter described in more detail, the limit stops 22 and 24 are designed with low resilience so as to absorb energy from the impact of the weight against either stop as heat rather than as energy tending to accelerate the weight 18 back in the opposite direction. In other words, the limit stops 22 and 24 act as shock absorbers for damping the reciprocal motion of the weight 18.

In operation, the weight 18 normally moves to position itself against one or the other of the limit stops 22 and 24. The rolling motion of the ship or vessel in moving the tube 16 causes one of the stops and the weight to come together. The weight 18 is then accelerated with the stop by the lateral acceleration of the tube. The accelerating force acting on the weight therefore is the angular acceleration $\ddot{\phi}$ of the rolling vessel times the lever arm or height $h$, where $\phi$ is the roll angle as a function of time. The greater the height, the greater can be the force applied to the weight 18. As the vessel reaches its center position in the roll cycle, the weight achieves its maximum velocity. As the vessel rolls beyond the center position, the tube velocity decreases to zero as the boat reaches its maximum roll angle in the other direction. Because of its low friction, however, the weight 18 moves at substantially constant velocity along the length of the tube 16 at the maximum velocity until it strikes the limit stop at the other end of the tube. Substantially all of the energy of impact is then dissipated by the limit stop.

As the ship rolls in the opposite direction, the weight is again accelerated by the limit stop until the center position is restored and the weight again moves along the length of the tube toward the first limit stop. With each impact of the weight against the alternate limit stops, substantial energy is dissipated by the limit stops, thereby greatly damping the rolling movement of the vessel.

For effective operation of the stabilizer of the present invention, the unit should be mounted at a height above the roll center at which the lateral component of acceleration of the housing, due to the long lever arm above the roll center, exceeds the acceleration of the weight by gravity due to the incline of the housing with roll. Using small angle theory (the sine and tangent of small angles is approximately equal to the angle in radians) the angular accelerations of the housing can be expressed as $$\ddot{\Phi} = \Omega_R^2 \Phi$$

where $\phi$ is the roll angle and $\Omega$ R is the natural roll frequency in radians per second. The lateral acceleration $A_L$ of the housing with roll is then $$A_L = h\ddot{\Phi} = \Omega_R^2 \cdot \Phi \cdot h$$

The lateral acceleration due to gravity can be expressed $$A_g = \Phi g$$

where $g$ is the acceleration of gravity. For $A_L > Ag$, $$h > \frac{g}{\Omega_R^2}$$

The height $h$ is preferably made as large as practical, since the greater the value of $h$, the greater the acceleration of the weight by the end of the housing and therefore the greater the energy on impact of the weight with the opposite end of the housing.

Figure 2:
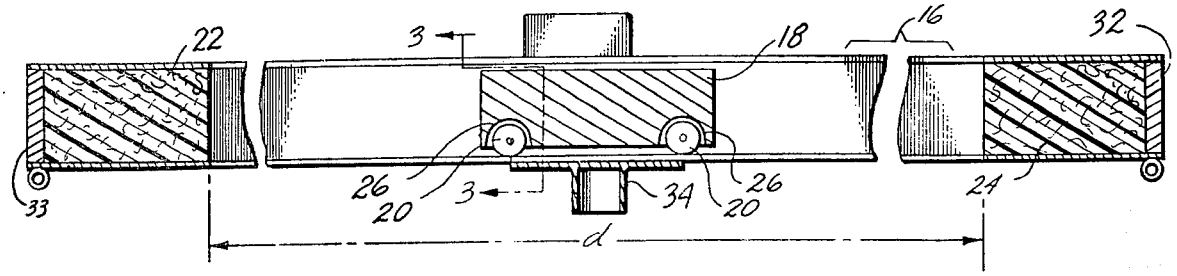
FIG. 2 is a sectional view showing the details of the roll stabilizer apparatus of FIG. 1.
Figure 3:
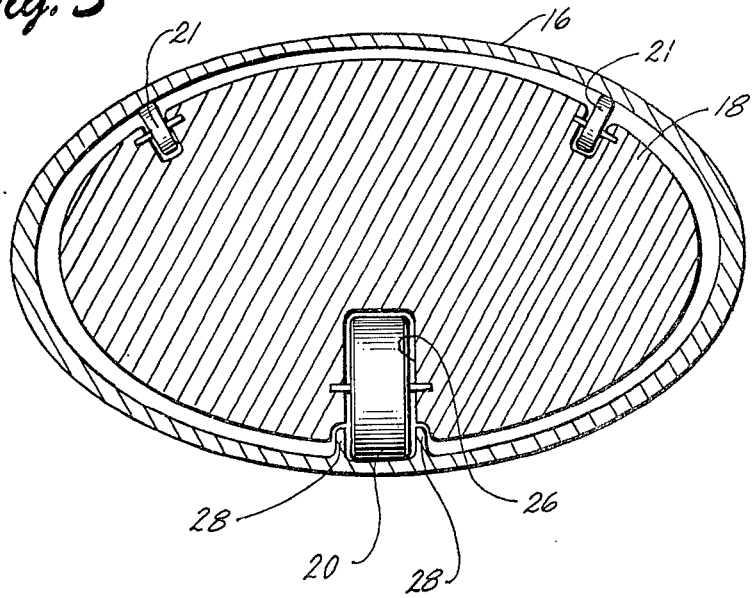
FIG. 3 is a sectional view taken substantially on the line 3—3 of FIG. 2.
Figure 4:
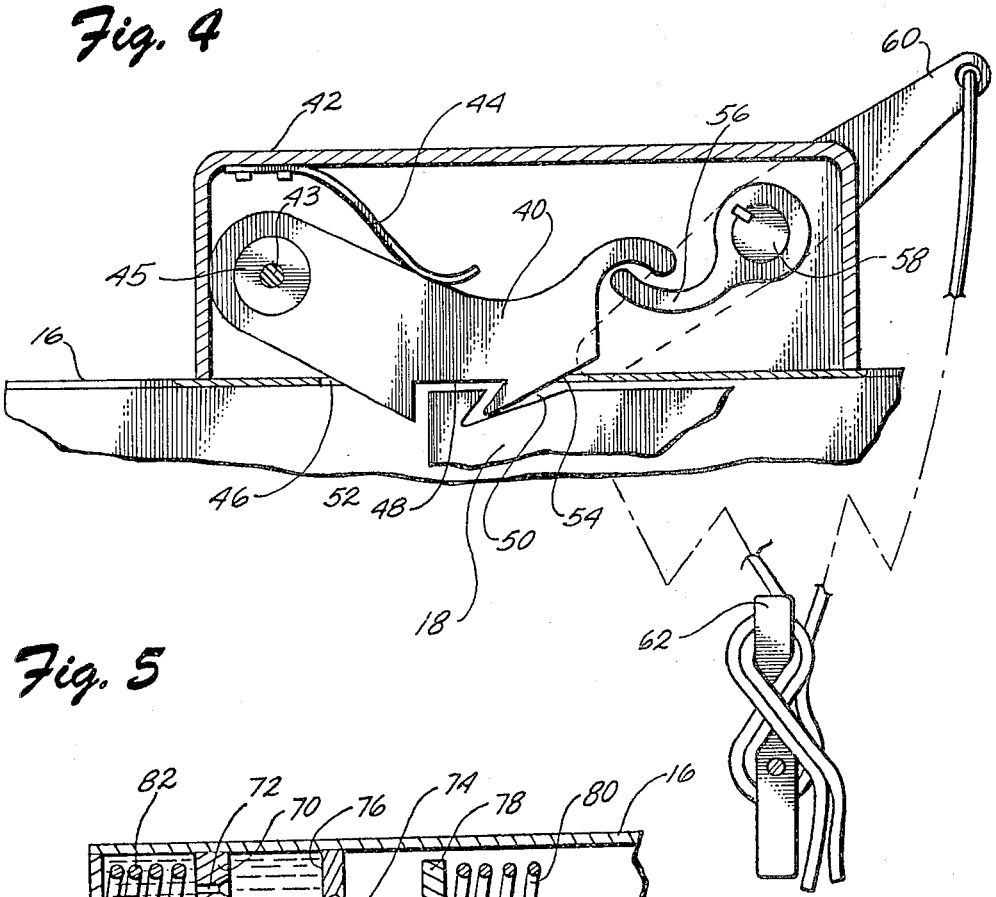
FIG. 4 is a partial sectional view showing the lock mechanism.

Referring to FIGS. 2, 3, and 4, the preferred embodiment of the invention is shown in more detail. The tube 16 is preferably in the form of an extruded plastic or metal tube which is oval-shaped in cross-section. The weight 18, which is also oval-shaped in cross-section, is smaller than the internal dimension of the tube 16 so as to be freely movable within the tube. The weight is supported by a pair of lower guide wheels 20 which are journaled in slots 26 in the lower center of the weight 18. The two lower wheels 20 are guided by a pair of integral flanges 28 formed in the bottom interior of the tube 16. Upper guide wheels 21, rotatably supported by the weight 18, lightly engage the upper interior wall surface of the tube 16 to center the weight and maintain effective clearance with the interior of the tube.

The limit stops 22 and 24 preferably include a length of plastic foam material, such as polyurethane foam, which is deformed on impact and which returns to its original shape in time to absorb the next impact. In other words, the polyurethane absorbs all the energy of impact, transforming the mechanical energy of the moving weight, dissipating it substantially in heat and not returning it to the weight as would a resilient spring. The weight and polyurethane stay in contact until the housing decelerates as it passes through the center position of the roll cycle. It may be desirable to make the polyurethane stop in several sections so that the material adjacent the point of impact is more easily crushable than the material more remote from the point of impact, thus providing a graduated stopping action which automatically accommodates itself to different impact velocities resulting from various degrees of rolling action. The polyurethane stops are held in place by end plates 30 and 32 which are removably mounted in the ends of the tube 16. The stabilizer assembly is mounted on top a mast or other suitable support high above the deck, such as by a mounting bracket 34 at the center of the tube 16 and by suitable guy wires which are secured to either end of the tube 16.

When not in use it is desirable that the weight be locked in a fixed position, preferably midway between limit stops 22 and 24. To this end a latch mechanism, as shown in FIGS. 3 and 4, may be provided. The latch mechanism includes a lock member 40 pivoted at one end to the inside of a housing 42 mounted on top of the tube 16 by means of a shaft 43 and a shock absorbing rubber bushing 45. The lock member 40 is urged downward by a spring 44 through a slot 46 in the top of the tube 16. The lock member 40 has a notch 48 along the lower margin thereof, which engages the portion of the weight 18 formed by a recess 50 formed in the weight. The lower margins of the lock member 40 extend at an angle, as indicated at 52 and 54, so that the lock member is wedged upwardly by the ends of the weight as the weight moves into the locking zone from either direction. When the weight reaches the position shown in FIG. 4, the locking member 40 drops down into the recess 50 under the action of the spring 44, securing the weight 18 from movement in either direction. The spring is made light enough so that if the weight is moving very fast past the locking member, the locking member unit engages the weight. Only when the velocity of the weight drops below a safe speed will the latch engage, halting the movement of the weight.

The locking member 40 is released by a release lever 56 mounted on a shaft 58 journaled in the walls of the housing 42. One end of the shaft 58 extends outside of the housing and is attached to a control arm 60. Lines attached to opposite ends of the control arm 60 are used to rotate the control arm 60 from the base of the mast or other convenient location. The lines are secured around a cleat 62 to hold the arm 60 in either of two operative positions. Rotation of the shaft 58 by the arm 60 causes the release lever 56 to push the locking member 40 upwardly and out of engagement with the weight 18, thereby releasing the weight 18 for free movement within the tube 16.

Figure 5:
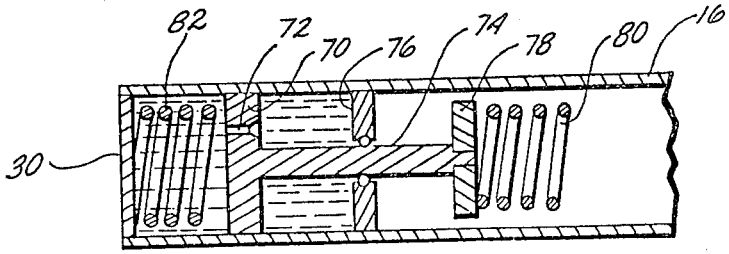
FIG. 5 is a partial sectional view showing an alternative form of damping mechanism.

An alternative shock absorber arrangement for absorbing and dissipating energy from the moving weight 18 is shown in FIG. 5. This arrangement includes a dash pot which includes a piston 70 having an orifice 72 providing a fluid passage between regions on the front and back of the piston 70. The piston is actuated through a plunger 74 which extends through an opening in an end wall 76. The space on either side of the piston 70 is filled with a suitable hydraulic fluid. The plunger 74 terminates in an end plate 78 to which is attached a coil spring 80. A second coil spring 82 is positioned between the end of the piston 70 and the wall 30 at the end of the tube 16. As the weight moves along the length of the tube, it strikes against the spring 80, forcing the piston against the spring 82 and squeezing the fluid out through the orifice 72. In the process, the fluid absorbs energy from the system which is dissipated in the form of heat.

Figure 6:
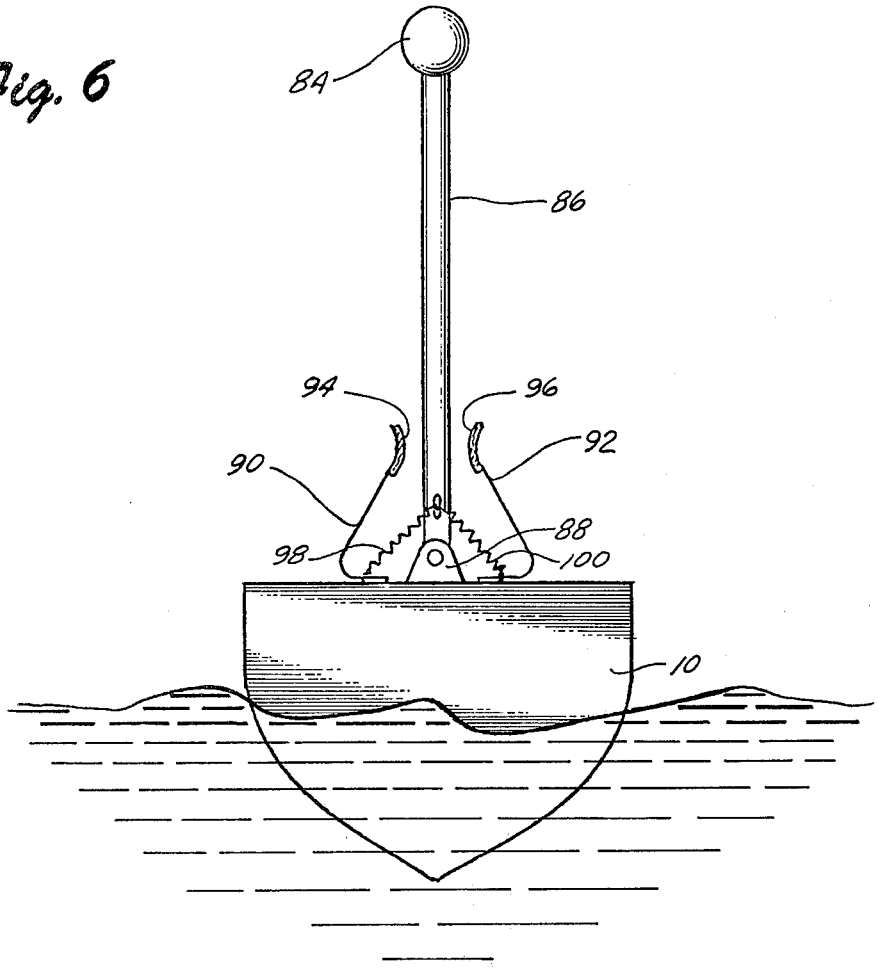
FIG. 6 is a schematic showing of an alternative embodiment of a roll stabilizer utilizing the principles of the present invention.

An alternative embodiment of the roll stabilizer is shown in FIG. 6. In this arrangement a weight 84 is mounted on top of a long mast 86 which is pivotally supported at its lower end to the deck of the vessel 10 by a bracket 88. This inverted pendulum arrangement is unstable and tends to move over against one or the other of two stops. The stops are in the form of supporting leaf springs 90 and 92, anchored to the deck on either side of the bracket 88 and terminating at their upper ends with friction pads 94 and 96, which are engaged by the mast 86. The momentum of the mast 86 striking against the pads 94 and 96, as the weight 84 is thrown back and forth by the rolling action of the ship, results in a friction loss between the pad and the engaging mast 86 during the deflection of the supporting springs 90 and 92. A pair of coil springs 98 and 100 are connected between the mast 86 and the deck of the vessel 10 in a manner to produce a centering action on the mast 86. However, the coil springs 98 and 100 are only just stiff enough to effectively neutralize the action of gravity in moving the weight and associated mast over against one or the other of the stops when the deck is level. This insures that the slightest rolling action will cause the weight in the mast 86 to be thrown back and forth between the two stops to achieve a damping action from the energy dissipated by the friction pads 94 and 96.

Figure 7:
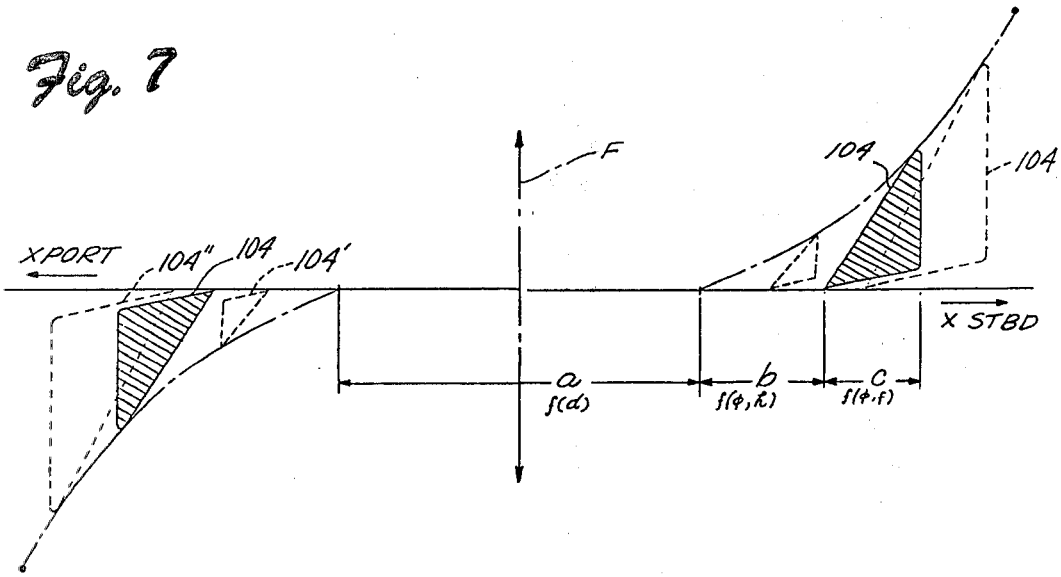
FIG. 7 is a diagram useful in explaining the operation of the present invention.

FIG. 7 is a plot of the excitation force F acting on the weight as a function of the movement of the weight from side to side against the energy absorbing stops. The curve 104 shows a hysteresis curve for the roll stabilizer according to the present invention. Between the limits of the two stops ($a$) there is substantially zero force (other than the force of gravity) acting on the weight 18. The length of $a$ is solely a function of the distance $d$ (see FIG. 2) that the weight moves along the tube between the points of contact with the stops. The weight moves an additional distance ($b$) relative to the vertical plane through the roll center RC because the tube moves with the rolling of the ship. This distance $b$ is a function of the size of the roll angle $\phi$ and the height $h$. When the weight makes contact with either polyurethane stop, the force acting on the weight 18 builds up until the polyurethane is compressed to the point that the weight is no longer moving within the tube. This distance $c$ is a function of the roll angle $\phi$ and the roll frequency $f$. The force then drops abruptly down to a level corresponding to the relatively small restoring force produced by the polyurethane. Once the weight 18 begins to move along the tube in the other direction, the force acting on the weight (other than the force of gravity) drops to zero. The total area under the hysteresis loop at either end of the travel of the weight represents the energy absorbed by the system. As the roll angle decreases, $b$ decreases, resulting in the hysteresis curve of $\psi'$. For a larger roll angle the hysteresis curve is as indicated at 104 ''. It will be seen that the system absorbs more energy as the roll angle increases.

In contrast to the other passive stabilizer systems in which the weight oscillates about the center of its movement relative to the ship, the weight 18 is not self-centering but moves unstably against one limit stop or the other. It remains in contact with one or the other of the limit stops during a substantial portion of each roll cycle of the vessel, namely, from the time of impact with a stop, usually near either extreme of the roll, until the vessel returns to the mid roll or fully upright position. Thus the time of contact of the weight with the limit stops may be of the order of half the roll period of the vessel.

It has been found that a 70-pound weight moving through an 8 ½ foot long tube with 20 inches of foam damping material at either end, when positioned 16 feet above the roll center of a 27 foot boat having a 10,000 pound displacement, can reduce the roll angle from a 15° to 20° roll with the weight locked in the Off position down to 1° to 2° roll maximum with the weight free to move back and forth in the tube. Thus it will be seen that the invention is extremely effective in stabilizing the roll of a vessel. The device is equally effective whether the boat is underway or at rest. It is effective over a wide range of wave and roll frequencies.

What is claimed is:

1. A passive non-linear energy absorbing dynamic mass system for limiting the roll of a floating vessel comprising a moving mass, a longitudinal guide member, means movably supporting the mass on the guide member for substantially free and undamped movement along the full length of the guide member, mounting means for mounting the guide member on the vessel with the path of movement of the mass extending transversely to the roll axis of the vessel, the energy absorbing means secured to the guide member and positioned at separated points along said path for limiting the length of free movement of the mass, the energy absorbing means absorbing substantially all the kinetic energy of the mass from impacts with the moving mass and dissipating it as heat to prevent recoil acceleration of the mass on impact, the amount of free movement of the mass along the guide means between the energy absorbing means being substantially greater than the motion accommodation distance of the energy absorbing means, the mass when the vessel is in a static level position being free along the full length of the guide member between the energy absorbing means of any forces tending to restore the mass to a central position.

2. Apparatus of claim 1 wherein the weight of the moving mass is of the order of ½% of the displacement weight of the vessel.

3. Apparatus of claim 1 further including releasable locking means secured to the guide member and engageable with the mass for securing the mass against movement along said guide member thereby to disable the system.

4. Apparatus of claim 1 wherein the energy absorbing means comprises blocks of polyurethane foam.

5. Apparatus of claim 1 wherein said energy absorbing means includes a hydraulic shock absorbing device engaged by the mass at the limits of travel at either end of said guide member.

6. Apparatus of claim 1 wherein said energy absorbing means includes a body of self-restoring plastic foam material engaged and compressed by the mass at either end of said guide member.

7. Apparatus of claim 6 wherein the body of plastic foam varies in stiffness throughout the length of the body in the direction of the moving mass.

8. Apparatus of claim 1 wherein the mounting means supports the guide member at a height above the roll axis of the vessel that is substantially greater than the ratio of the acceleration of gravity to the square of the natural roll frequency of the vessel.

9. Apparatus for stabilizing a rolling vessel, comprising:

means supporting a weight from a vessel above the roll center for free and undamped movement relative to the vessel, means restricting the movement of the weight relative to the vessel to a path transverse to the roll axis of the vessel, stop means spaced along the path for limiting the movement of the weight along said path, said supporting means providing unstable support of the weight when the vessel is in a static level position, whereby the weight tends to move toward and remain against the stop means at either end of the path of the weight with the slightest tilt of the vessel in either direction, said restricting means affording free undamped transverse motion of the weight between the stop means, the stop means including mechanical energy absorbing and dissipating means having very low resilience so that the weight does not rebound along the path following impact with the stop means, the total motion accommodation distance of the stop means being substantially less than the distance along the path between the stop means whereby the weight is free of contact with the stop means during a substantial portion of its movement along said path.

* * * * *